US008393978B2

(12) United States Patent
Watanabe et al.

(10) Patent No.: US 8,393,978 B2
(45) Date of Patent: Mar. 12, 2013

(54) MULTI-PIECE SOLID GOLF BALL

(75) Inventors: Hideo Watanabe, Chichibu (JP); Akira Kimura, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 421 days.

(21) Appl. No.: 12/635,327

(22) Filed: Dec. 10, 2009

(65) Prior Publication Data

US 2011/0143861 A1 Jun. 16, 2011

(51) Int. Cl.
*A63B 37/04* (2006.01)

(52) U.S. Cl. ..... 473/373; 473/378

(58) Field of Classification Search ..... 473/373, 473/378

See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,782,707 | A * | 7/1998 | Yamagishi et al. | 473/374 |
| 6,194,505 | B1 | 2/2001 | Sone et al. | |
| 6,319,155 | B1 * | 11/2001 | Moriyama et al. | 473/378 |
| 6,533,683 | B2 * | 3/2003 | Watanabe | 473/374 |
| 6,592,470 | B2 | 7/2003 | Watanabe et al. | |
| 6,642,314 | B2 | 11/2003 | Sone et al. | |
| 6,663,507 | B1 | 12/2003 | Watanabe et al. | |
| 6,702,695 | B1 | 3/2004 | Higuchi et al. | |
| 6,723,008 | B2 | 4/2004 | Higuchi et al. | |
| 6,739,986 | B2 | 5/2004 | Higuchi et al. | |
| 6,746,345 | B2 | 6/2004 | Higuchi et al. | |
| 6,814,676 | B2 | 11/2004 | Watanabe et al. | |
| 6,846,250 | B2 | 1/2005 | Higuchi et al. | |
| 7,294,680 | B2 | 11/2007 | Sone et al. | |
| 7,563,180 | B2 | 7/2009 | Watanabe et al. | |
| 7,625,302 | B2 * | 12/2009 | Watanabe et al. | 473/376 |
| 2007/0281802 | A1 * | 12/2007 | Watanabe et al. | 473/371 |
| 2008/0176676 | A1 * | 7/2008 | Watanabe et al. | 473/376 |
| 2008/0220900 | A1 * | 9/2008 | Komatsu | 473/373 |
| 2009/0036234 | A1 | 2/2009 | Nanba et al. | |

FOREIGN PATENT DOCUMENTS

| | | | |
|---|---|---|---|
| JP | 11-035633 | A | 2/1999 |
| JP | 11-164912 | A | 6/1999 |
| JP | 2001-054588 | A | 2/2001 |
| JP | 2002-085587 | A | 3/2002 |
| JP | 2002-085588 | A | 3/2002 |
| JP | 2002-085589 | A | 3/2002 |
| JP | 2002-186686 | A | 7/2002 |
| JP | 2002-293996 | A | 10/2002 |
| JP | 2002-315848 | A | 10/2002 |
| JP | 2003-190330 | A | 7/2003 |
| JP | 2004-049913 | A | 2/2004 |
| JP | 2005-211656 | A | 8/2005 |
| JP | 2009-034505 | A | 2/2009 |
| WO | 98/46671 | A1 | 10/1998 |

* cited by examiner

*Primary Examiner* — Gene Kim
*Assistant Examiner* — Matthew B Stanczak
(74) *Attorney, Agent, or Firm* — Sughrue Mion, PLLC

(57) ABSTRACT

The invention provides a multi-piece solid golf ball having a solid core, at least one intermediate layer and a cover. The core has a hardness which gradually increases from a core center to a core surface, with the golf ball having specific values for the hardness difference between the core center and the core surface; the hardness difference (I)-(II) in JIS-C hardness units being not more than ±2; the (hardness of intermediate layer material)−(hardness of core surface); the (initial velocity of sphere composed of core encased by intermediate layer)−(initial velocity of core); the (deflection of sphere composed of core encased by intermediate layer)/(deflection of core); and the (hardness of cover material)−(hardness of intermediate layer material).

6 Claims, 2 Drawing Sheets

MULTI-PIECE SOLID GOLF BALL

BACKGROUND OF THE INVENTION

The present invention relates to a multi-piece solid golf ball composed of a core on which an intermediate layer and a cover have been formed as successive layers. More specifically, the invention relates to a multi-piece solid golf ball which has an excellent flight performance and feel and has a good durability to repeated impact and a good scuff resistance.

The major performance attributes required of golf balls include distance, controllability, durability and feel on impact; balls having the highest levels of such attributes are constantly being sought. In this context, there has emerged among recent golf balls a succession of balls with multilayer structures—typically three-piece balls. Providing a golf ball with a multilayer structure makes it possible to combine many materials of differing properties; by assigning various functions to the respective layers, a wide diversity of ball designs can be achieved.

Among such golf balls, wide use is made of multi-piece solid golf balls in which the hardness relationships between each layer, such as an intermediate layer encasing the core and a cover layer, have been optimized. In recent years, elements regarded to be important in assessing ball performance include not only the flight performance, but also the durability of the ball to cracking and the scuff resistance—which is the ability to suppress burr formation on the ball surface. Therefore, designing the thickness, hardness and other properties of the respective ball layers in such a way as to maximize these desirable effects is a major challenge. Also, golf balls are commonly used not only by professionals and other skilled golfers, by also by amateur golfers having a relatively low head speed. Accordingly, there is a desire for the development of golf balls which, even when used by amateur golfers, enable a sufficient distance to be achieved.

Hence, there exists a need for golf balls which satisfy the conflicting demands for improved distance, controllability, durability and feel. In particular, there exists a desire for the development of a golf ball which, on shots with a driver, increases the distance by keeping the spin rate low and, on shots with an iron, provides a suitable spin rate, exhibits good controllability, and has an excellent durability to cracking and scuff resistance.

Art relating to the present invention is disclosed in, for example, JP-A 2003-190330, JP-A 2004-049913, JP-A 2002-315848, JP-A 2001-54588, JP-A 2002-85588, JP-A 2002-85589, JP-A 2002-85587, JP-A 2002-186686, JP-A 2009-34505 and JP-A 2005-211656. However, further improvement has been desired.

SUMMARY OF THE INVENTION

It is therefore an object of the present invention to provide a golf ball which, by optimizing the hardnesses of the intermediate layer and the cover and optimizing the core hardness profile, has an excellent flight performance and,a soft feel when played by amateur golfers, and moreover has a good scuff resistance and a good durability to repeated impact.

The inventors have conducted extensive investigations in order to achieve the above object. As a result, they have discovered that, with regard to the hardness profile of the core in a multi-piece solid golf ball having a core, an intermediate layer and a cover, by focusing both on the hardness difference between the core surface and the core center and on the hardness gradient in the core and working to optimize these, and by also optimizing the hardness relationship between the core and the respective layers (intermediate layer and cover) encasing the core, a lower spin rate can be achieved on full shots with a driver (W#1), giving the ball an improved distance. In addition, the inventors have found that, by combining with the above a cover formed primarily of polyurethane, the ball can also be endowed with an excellent durability to cracking on repeated impact and an excellent scuff resistance.

Accordingly, the invention provides the following multi-piece solid golf balls.

[1] A multi-piece solid golf ball comprising a solid core, at least one intermediate layer and a cover, wherein the core has a hardness which gradually increases from a core center to a core surface, the hardness difference in JIS-C hardness units between the core center and the core surface being at least 15 and, letting (I) be the average value for the cross-sectional hardness at a position 15 mm from the core center and the cross-sectional hardness at the core center and letting (II) be the cross-sectional hardness at a position 7.5 mm from the core center, the hardness difference (I)-(II) in JIS-C hardness units being not more than ±2; the intermediate layer has a material hardness and the core has a surface hardness which together satisfy the condition (JIS-C hardness of intermediate layer material)−(JIS-C hardness of core surface)>0;

a sphere composed of the core encased by the intermediate layer has an initial velocity and the core has an initial velocity which together satisfy the condition (initial velocity of sphere composed of core encased by intermediate layer)−(initial velocity of core)≧0;

the sphere composed of the core encased by the intermediate layer has a deflection and the core has a deflection which together satisfy the condition 0.80≦(deflection of sphere composed of core encased by intermediate layer)/(deflection of core);

the cover is formed of a cover material composed primarily of polyurethane; and the cover material has a Shore D hardness and the intermediate layer material has a Shore D hardness which together satisfy the condition (Shore D hardness of cover material)−(Shore D hardness of intermediate layer material)≦0.

[2] The multi-piece solid golf ball of [1], wherein the intermediate layer is formed primarily of a resin mixture obtained by blending as essential components:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio of from 100:0 to 0:100, and (B) a non-ionomeric thermoplastic elastomer in a weight ratio of from 100:0 to 50:50;

(C) from 5 to 120 parts by weight of a fatty acid and/or fatty acid derivative having a molecular weight of from 228 to 1500; and (D) from 0.1 to 17 parts by weight of a basic inorganic metal compound capable of neutralizing un-neutralized acid groups in component A and component C.

[3] The multi-piece solid golf ball of [1], wherein the hardness difference (I)-(II) in JIS-C units is not more than ±1.

[4] The multi-piece solid golf ball of [1], wherein the initial speed of the sphere composed of the core encased by the intermediate layer and the initial speed of the core together satisfy the condition (initial speed of sphere composed of core encased by intermediate layer)−(initial speed of core)≧0.2.

[5] The multi-piece solid golf ball of [1], wherein the deflection of the sphere composed of the core encased by the intermediate layer and the deflection of the core together satisfy the condition 0.80≦(deflection of sphere composed of core encased by intermediate layer)/(deflection of core)≦0.92.

[6] The multi-piece solid golf ball of [1], wherein the intermediate layer material has a Shore D hardness of from 50 to 60.

[7] The multi-piece solid golf ball of [1], wherein the ball has a deflection and the sphere composed of the core encased by the intermediate layer has a deflection which together satisfy the condition 0.85≦(ball deflection)/(deflection of sphere composed of core encased by intermediate layer)≦0.97.

BRIEF DESCRIPTION OF THE DIAGRAMS

DETAILED DESCRIPTION OF THE INVENTION

The invention is described in greater detail below.

Figure 1:
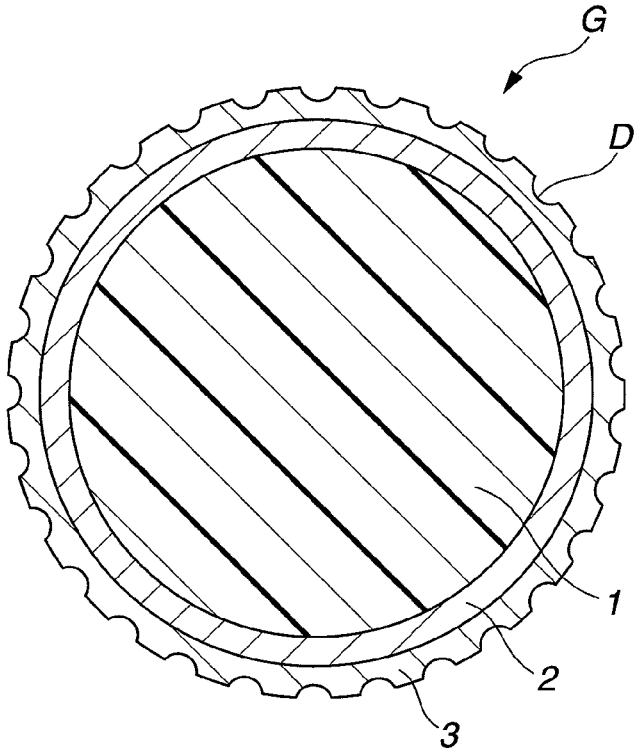
FIG. 1 is a schematic sectional view showing a multi-piece solid golf ball (3-layer construction) according to the invention.

The multi-piece solid golf ball of the present invention has a solid core, at least one intermediate layer, and a cover. FIG. 1 shows an exemplary construction of a golf ball G according to the present invention. Referring to FIG. 1, the golf ball G of the invention has a plurality of layers, including at least a core 1, an intermediate layer 2 which encases the core 1, and a cover 3 which encases the intermediate layer 2. The core 1 and the intermediate layer 2 are not limited to single layers, and may each be formed of a plurality of two more layers. The cover 3 typically has a large number of dimples D formed on the surface thereto to enhance the aerodynamic properties.

The core has a diameter which, while not subject to any particular limitation, is generally from 35 to 41 mm, preferably from 36 to 40 mm, and more preferably from 37 to 39 mm. At a core diameter outside this range, the ball may have a lower initial velocity or may have a less than adequate spin rate-lowering effect after the ball is hit, as a result of which an increased distance may not be achieved. As mentioned above, the core is not limited to a single layer, and may have a multilayer construction of two or more layers.

The core has a surface hardness which, while not subject to any particular limitation, has a JIS-C hardness value of generally from 68 to 90, preferably from 72 to 85, and more preferably form 75 to 82. The core has a center hardness which, while not subject to any particular limitation, has a JIS-C hardness value of generally from 50 to 70, preferably from 54 to 65, and more preferably from 56 to 62. If the above value is too small, the rebound of the core may be inadequate, as a result of which the ball may not achieve an increased distance, and the durability of the ball to cracking on repeated impact may worsen. On the other hand, if the above value is too high, the ball may have an excessively high spin rate on full shots, as a result of which an increased distance may not be achieved.

In the present invention, it is essential that the core have a hardness which gradually increases from the center to the surface of the core, the hardness difference between the core center and the core surface in JIS-C units being at least 15, preferably from 16 to 40, and more preferably from 18 to 35. If the hardness difference is too small, the spin rate-lowering effect on shots with a driver (W#1) may be inadequate, as a result of which the desired distance may not be achieved. On the other hand, if the hardness difference is too large, the initial velocity on impact may decrease, possibly keeping the desired distance from being achieved, and the durability to cracking on repeated impact may worsen. Also, even when the hardness difference is within the above-indicated range, cases in which the hardness is not fully optimized and thus does not gradually increase from the core center to the core surface are undesirable because the spin rate-lowering effect on shots with a driver (W#1) will be inadequate.

Figure 2:
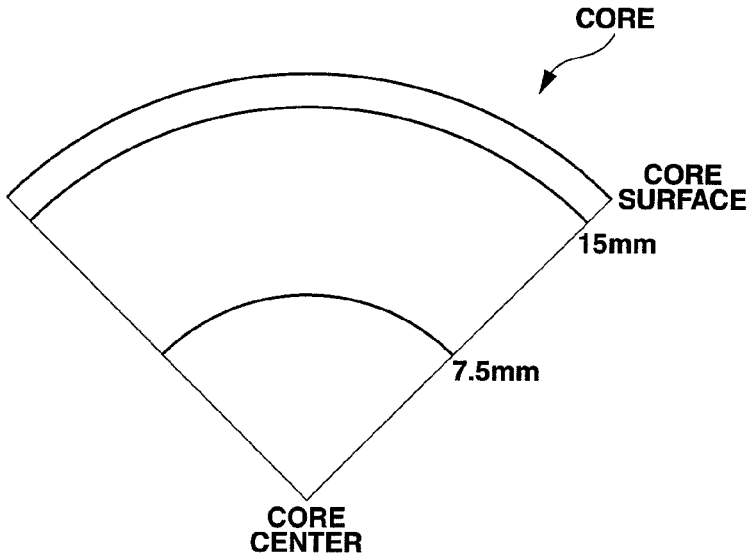
FIG. 2 is a diagram illustrating positions at the interior of the core.

Moreover, referring to FIG. 2, by optimizing the respective cross-sectional hardnesses at the core center and at positions located 7.5 mm and 15 mm from the core center, the spin rate-lowering effect on shots taken with a driver (W#1) can be enhanced. Specifically, letting (I) be the average value for the cross-sectional hardness at a position 15 mm from the core center and the cross-sectional hardness at the core center and letting (II) be the cross-sectional hardness at a position 7.5 mm from the core center, it is critical for the hardness difference (I)-(II) therebetween in JIS-C hardness units to be not more than ±2. This means that in a case where the core center has a JIS-C hardness of 60 and the JIS-C hardness at a position 15 mm out from the core center is 74, because the average (I) thereof is a JIS-C hardness of 67, the JIS-C hardness (II) at a position 7.5 mm from the core center (corresponding to a point midway between the core center and the position 15 mm from the core center) is within a range of ±2 of the above average value of 67. This parameter serves in the inventive golf ball as an indicator showing that the hardness has a slope at which it increases linearly from the core center to the core surface.

The above hardness difference (I)-(II) is preferably not more than ±1 JIS-C hardness unit, and is more preferably ±0; that is, (II) is more preferably identical to the above average value (I). If this hardness difference is too large, the core hardness slope will not be linear, as a result of which the spin rate-lowering effect on shots with a driver (W#1) may be inadequate and the desired distance may not be achieved.

The deflection when the core is subjected to loading, i.e., the deflection (mm) of the core when compressed under a final load of 1,275 N (130 kgf) from an initial load of 98 N (10 kgf), while not subject to any particular limitation, is generally from 3.0 mm to 6.0 mm, preferably from 3.4 mm to 5.0 mm, and more preferably from 3.7 mm to 4.5 mm. If this value is too large, the core may lack sufficient rebound, which may result in a less than satisfactory distance, and the durability of the ball to cracking on repeated impact may worsen. On the other hand, if this value is too small, the ball may have an excessively hard feel on full shots, and the spin rate may be too high, as a result of which an increased distance may not be achieved.

In the present invention, as described above, it is especially critical for the hardness to increase gradually from the core center toward the core surface, and it is also essential for the core cross-sectional hardness profile and the core deflection to be optimized within the specified ranges. When sulfur, for example, is included for this purpose in formulating the core-forming material, although the outcome will vary also with the various types of additives which are included and the vulcanization conditions, there is a possibility that, during rubber vulcanization, the region near the center of the core will end up being soft, as a result of which the desired linear hardness gradient may not be achieved.

A rubber material may be used as the primary material in the above core-forming material. For example, the core may be formed of a rubber composition containing, in addition to the rubber material, a co-crosslinking agent, an organic peroxide, an inert filler, an organosulfur compound and the like. It is preferable to use polybutadiene as the base rubber of this rubber composition. In the present invention, as mentioned above, it is critical for the hardness to gradually increase from the core center to the core surface, and it is essential for the core cross-sectional hardness profile to be optimized in a specific way.

In the present invention, rubber compositions preferable for forming the above solid core are exemplified by rubber compositions formulated as shown below.

The core used in the present invention may be a rubber core which has been molded and vulcanized from a rubber composition composed primarily of a base rubber. Specifically, the core may be formed using a molded and vulcanized rubber composition containing, in addition to the base rubber: a co-crosslinking agent, an organic peroxide, an inert filler, and an organosulfur compound.

Polybutadiene is preferably used as the base rubber of the above core-forming rubber composition. It is desirable for this polybutadiene to have a cis-1,4-bond content on the polymer chain of at least 60 wt %, preferably at least 80 wt %, more preferably at least 90 wt %, and most preferably at least 95 wt %. Too low a cis-1,4-bond content among the bonds on the molecule may lead to a lower resilience. Moreover, the polybutadiene has a 1,2-vinyl bond content on the polymer chain of preferably not more than 2%, more preferably not more than 1.7%, and even more preferably not more than 1.5%. Too high a 1,2-vinyl bond content may lead to a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the rubber composition insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of preferably at least 5 parts by weight, more preferably at least 10 parts by weight, and even more preferably at least 15 parts by weight. The amount included is preferably not more than 60 parts by weight, more preferably not more than 50 parts by weight, even more preferably not more than 40 parts by weight, and most preferably not more than 30 parts by weight. Too much may make the core too hard, giving the ball an unpleasant feel on impact, whereas too little may lower the rebound.

The organic peroxide may be a commercially available product, suitable examples of which include Percumyl D (available from NOF Corporation), Perhexa 3M (NOF Corporation), Perhexa C40 (NOF Corporation) and Luperco 231XL (Atochem Co.). These may be used singly.

The amount of organic peroxide included per 100 parts by weight of the base rubber is preferably at least 0.1 part by weight, more preferably at least 0.3 part by weight, even more preferably at least 0.5 part by weight, and most preferably at least 0.7 part by weight. The upper limit in the amount included is preferably not more than 5 parts by weight, more preferably not more than 4 parts by weight, even more preferably not more than 3 parts by weight, and most preferably not more than 2 parts by weight. Too much or too little organic peroxide may make it impossible to achieve a ball having a good feel, durability and rebound.

Examples of suitable inert fillers include zinc oxide, barium sulfate and calcium carbonate. These may be used singly or as a combination of two or more thereof.

The amount of inert filler included per 100 parts by weight of the base rubber is preferably at least 1 part by weight, and more preferably at least 5 parts by weight. The upper limit in the amount included is preferably not more than 100 parts by weight, more preferably not more than 80 parts by weight, and even more preferably not more than 60 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 and Nocrac 200 (all available from Ouchi Shinko Chemical Industry Co., Ltd.), and Yoshinox 425 (available from Yoshitomi Pharmaceutical Industries, Ltd.). These may be used singly or as a combination of two or more thereof.

The amount of antioxidant included may be set to more than 0, and may be set to an amount per 100 parts by weight of the base rubber of preferably at least 0.05 part by weight, and especially at least 0.1 part by weight. The upper limit in the amount included, although not subject to any particular limitation, may be set to an amount per 100 parts by weight of the base rubber of preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable core hardness gradient, a good rebound and durability, and a spin rate-lowering effect on full shots.

The rubber composition containing the various above ingredients is prepared by mastication using a typical mixing apparatus, such as a Banbury mixer or a roll mill. When this rubber composition is used to mold the core, molding may be carried out by compression molding or injection molding using a specific mold for molding cores. The resulting molded body is then heated and cured under temperature conditions sufficient for the organic peroxide and co-crosslinking agent included in the rubber composition to act, thereby giving a core having a specific hardness profile. The vulcanization conditions in this case, while not subject to any particular limitation, are generally set to conditions of about 130 to 170° C., and especially 150 to 160° C., for 10 to 40 minutes, and especially 12 to 20 minutes.

The golf ball of the present invention has at least one intermediate layer which encases the above core, and has a cover which encases the intermediate layer. These layers must each satisfy the following conditions, and must fulfill the subsequently described relationships with respect to other layers. First, the respective conditions for the intermediate layer and the cover are described.

The intermediate layer material has a Shore D hardness of preferably at least 40, more preferably at least 45, and even more preferably at least 50, with the upper limit value being preferably not more than 70, more preferably not more than 60, and even more preferably not more than 56. The intermediate layer material has a hardness, expressed as the JIS-C hardness, of preferably at least 63, more preferably at least 70, and even more preferably at least 76, with the upper limit value being preferably not more than 100, more preferably not more than 89, and even more preferably not more than 84. If the intermediate layer material is too much softer than the above range, on shots with a driver (W#1), the ball may have a decreased rebound or the spin rate may rise excessively, as a result of which a sufficient distance may not be achieved. On the other hand, if the intermediate layer material is too hard, the durability to cracking on repeated impact may worsen or the ball may have a poor feel.

The intermediate layer has a thickness which, although not subject to any particular limitation, may be set to preferably from 0.8 to 2.5 mm, more preferably from 1.0 to 1.8 mm, and even more preferably from 1.2 to 1.6 mm. If the intermediate layer thickness is too small, the durability to cracking on repeated impact may worsen, or the ball rebound may decrease, as a result of which an increased distance may not be achieved. On the other hand, if the intermediate layer thickness is too large, the spin rate on shots with a driver (W#1) may increase, as a result of which an increased distance may not be achieved.

The structure of the above-described intermediate layer is not limited to a single layer; where necessary, two or more like or unlike intermediate layers may be formed within the above range. By forming a plurality of intermediate layers, the spin rate on shots with a driver can be further reduced, enabling an even greater increase in distance to be achieved. In addition, the spin properties and feel of the ball on impact can be further improved.

The hardness of the cover material, in terms of the Shore D hardness, is set to preferably from 35 to 65, more preferably from 40 to 60, and even more preferably from 45 to 55. If the above hardness is too low, the spin rate on shots with a driver may increase, lowering the distance traveled by the ball. On the other hand, if the hardness is too high, the ball may not incur spin in the short game, or cracking of the ball under repeated impact may worsen.

The cover thickness, while not subject to any particular limitation, is preferably from 0.4 to 2.0 mm, more preferably from 0.6 to 1.5 mm, and even more preferably from 0.8 to 1.0 mm. If the cover thickness is too large, the ball may be too receptive to spin, as a result of which an increased distance may not be achieved. On the other hand, if the cover thickness is too small, the ball may be too unreceptive to spin in the short game, resulting in a poor controllability, or the scuff resistance may worsen.

The construction of the above cover is not limited to one layer. If necessary, a cover of two or more layers may be formed using like or unlike materials.

Next, the relationships between the above core, intermediate layer and cover are described in detail.

In the present invention, it is essential for the difference between the hardness of the intermediate layer material and the hardness of the core surface to satisfy the following condition: (JIS-C hardness of intermediate layer material)−(JIS-C hardness of core surface)>0. The range in this hardness difference is preferably set to from 2 to 10, and more preferably from 3 to 7. Outside of this range, the spin rate on impact with a driver (W#1) may increase, making it impossible to achieve an increased distance, the durability to cracking under repeated impact may worsen, and the feel may worsen.

Also, it is essential for the difference between the Shore D hardness of the cover material and the Shore D hardness of the intermediate layer material to satisfy the following condition: (Shore D hardness of cover material)−(Shore D hardness of intermediate layer material)≦0. The range in this hardness difference is preferably less than 0, more preferably from −1 to −10, and even more preferably from −2 to −7. If this hardness difference is a value larger than the above range, the ball may be too receptive to spin in the short game, resulting in a poor controllability, or the durability to cracking under repeated impact may worsen. On the other hand, at a value smaller than the above range in the hardness difference, the spin rate on shots with a driver (W#1) may rise excessively, as a result of which a sufficient distance may not be achieved.

It is also essential for the difference between the initial velocity (m/s) of the sphere composed of the core encased by the intermediate layer and the initial velocity (m/s) of the core to satisfy the following condition: (initial velocity of sphere composed of core encased by intermediate layer)−(initial velocity of core)≧0. The range in this initial velocity difference is preferably at least 0.2 m/s, and more preferably at least 0.4 m/s. If this value is too small, the ball rebound may be inadequate, or the spin rate-lowering effect on shots with a driver (W#1) may be insufficient, as a result of which an increased distance may not be achieved.

Furthermore, it is essential for the relationship between the deflection of the sphere composed of the core encased by the intermediate layer and the deflection of the core to satisfy the following condition: 0.80≦(deflection of sphere composed of core encased by intermediate layer)/(deflection of core). The range is preferably from 0.80 to 0.92, and more preferably from 0.85 to 0.90. This parameter serves in this invention as an indicator expressing the influence of the hardness and thickness of the intermediate layer. If the above value is too low, the spin rate on shots with a driver (W#1) may increase or the rebound of the ball may become low, as a result of which an increased distance may not be achieved. On the other hand, if the above value is too large, the durability to cracking on repeated impact may worsen or the feel of the ball may be too hard. Here, the phrase "deflection of sphere composed of core encased by intermediate layer" refers to the deflection when the sphere composed of the core encased by the intermediate layer is compressed under a final load of 1,275 N (130 kg) from an initial load of 98 N (10 kgf).

In addition, it is essential for the relationship between the ball deflection and the deflection of a sphere composed of the core encased by the intermediate layer to satisfy the following condition: 0.85≦(ball deflection)/(deflection of sphere composed of core encased by intermediate layer)≦0.97. This range is preferably set to from 0.87 to 0.95, and especially from 0.89 to 0.93. This parameter serves in this invention as an indicator expressing the cover hardness and thickness. If the above value is too small, the spin rate on shots with a driver (W#1) may increase, as a result of which an increased distance may not be achieved. On the other hand, if the value is too large, the durability to cracking under repeated impact may worsen, the feel of the ball may become too hard, or the spin rate on approach shots may be too small, resulting in a poor controllability.

The ball obtained by means of the above-described construction has an initial velocity of preferably at least 76.5 m/s, more preferably at least 76.8 m/s, and even more preferably at least 77.0 m/s. On the other hand, the upper limit value in the initial velocity is 77.724 m/s. If the initial velocity of the ball is too low, an increase in distance may not be achieved. On the other hand, if the initial velocity exceeds the upper limit of 77.724 m/s, it will fail to meet the standard set by the R&A (USGA), and will thus be ineligible for registration as an official ball.

The golf ball obtained by encasing the above core with the above intermediate layer and cover has a deflection which, although not subject to any particular limitation, is preferably from 2.5 to 4.0 mm, more preferably from 2.7 to 3.7 mm, and even more preferably from 2.9 to 3.4 mm. If this value is too large, the ball may have an inadequate rebound, making it difficult to increase the distance, or the durability to cracking under repeated impact may worsen. On the other hand, if this value is too small, the spin rate on full shots may be too high, as a result of which an increased distance may not be achieved, or the feel on impact may become too hard. As used herein, the ball deflection is the deflection when the ball is compressed under a final load of 1,275 N (130 kgf) from an initial load of 98 N (10 kgf).

Also, in the inventive golf ball, although not subject to any particular limitation, in addition to the above parameters, to further enhance the flight performance, scuff resistance and durability to repeated impact, it is preferable to form the ball so that the cover and intermediate layer thicknesses (mm) satisfy the following relationship:

$$\text{cover thickness} \leqq \text{intermediate layer thickness}.$$

It is more preferable to satisfy the relationship:

$$\text{cover thickness} \leqq \text{intermediate layer thickness},$$

and even more preferable to satisfy the relationship:

$$\text{cover thickness} \times 1.2 \leqq \text{intermediate layer thickness} \leqq \text{cover thickness} \times 2.5.$$

By having the cover and intermediate layer thicknesses satisfy the above relationship, the ball rebound can be enhanced, the spin rate of the ball on full shots can be reduced, and the scuff resistance and durability to repeated impact may be further improved.

In the present invention, illustrative, non-limiting, examples of resin compositions preferable for forming the above intermediate layer and cover include the resin compositions formulated as shown below.

First, it is preferable to use as the intermediate layer-forming resin composition a resin composition obtained by blending:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio of from 100:0 to 0:100, and (B) a non-ionomeric thermoplastic elastomer in a weight ratio of from 100:0 to 50:50;

(C) from 5 to 120 parts by weight of a fatty acid and/or fatty acid derivative having a molecular weight of from 228 to 1500; and (D) from 0.1 to 17 parts by weight of a basic inorganic metal compound capable of neutralizing un-neutralized acid groups in component A and component C.

Components A to D are described below.

Component A is a base resin of the intermediate layer-forming resin composition in which component (a-1) is an olefin-unsaturated carboxylic acid random copolymer and/or a metal ion neutralization product of an olefin-unsaturated carboxylic acid random copolymer, and component (a-2) is an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer.

Here, the olefins in above component (a-1) and component (a-2) are olefins in which the number of carbons is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

The unsaturated carboxylic acid ester in above component (a-2) is exemplified by lower alkyl esters of the above unsaturated carboxylic acids. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred.

The olefin-unsaturated carboxylic acid random copolymer of above component (a-1) and the olefin-unsaturated carboxylic acid-unsaturated carboxylic acid ester random terpolymer of above component (a-2) (these are sometimes referred to collectively below as "random copolymers") can each be obtained by using a known method to random copolymerize the above-described olefin, unsaturated carboxylic acid and, where necessary, unsaturated carboxylic acid ester.

It is desirable that the above random copolymers have controlled unsaturated carboxylic acid contents (acid contents). In this case, it is recommended that the content of unsaturated carboxylic acid in component (a-1) be preferably at least 4 wt %, more preferably at least 6 wt %, even more preferably at least 8 wt %, and most preferably at least 10 wt %, but preferably not more than 30 wt %, more preferably not more than 20 wt %, even more preferably not more than 18 wt %, and most preferably not more than 15 wt %. It is recommended that the content of unsaturated carboxylic acid in component (a-2) be preferably at least 4 wt %, more preferably at least 6 wt %, and even more preferably at least 8 wt %, but preferably not more than 15 wt %, more preferably not more than 12 wt %, and even more preferably not more than 10 wt %. If the unsaturated carboxylic acid content in above component (a-1) and/or component (a-2) is too low, the ball rebound may decrease, whereas if it is too high, the processability of the resin material may decrease.

The metal ion neutralization product of the olefin-unsaturated carboxylic acid random copolymer of above component (a-1) and the metal ion neutralization product of the olefin-unsaturated carboxylic acid-unsaturated carboxylic acid ester random terpolymer of above component (a-2) (these are referred to collectively below as "metal ion neutralization products of the random copolymers") can be obtained by neutralizing some or all of the acid groups on the respective above random copolymers with metal ions.

Illustrative examples of metal ions for neutralizing acid groups in the above random copolymers include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. In the present invention, of these, preferred use may be made of $Na^+$, $Li^+$, $Zn^{++}$ and $Mg^{++}$; $Mg^{++}$ and $Zn^{++}$ are especially recommended. The degree of neutralization of these random copolymers with the above metal ions is not subject to any particular limitation. These neutralization products may be obtained by a known method. For example, compounds such as formates, acetates, nitrates, carbonates, bicarbonates, oxides, hydroxides and alkoxides of the aforementioned metal ions may be used by being introduced into the above random copolymer.

Commercially available products may be used as above component A. Examples of commercial products that may be used as the random copolymer in above component (a-1) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical). Examples of commercial products that may be used as the metal ion neutralization product of the random copolymer in above component (a-1) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110. and Iotek 4200 (ExxonMobil Chemical). Examples of commercial products that may be used as the random copolymer in above component (a-2) include Nucrel AN 4311, Nucrel AN 4318, Nucrel AN 4319 and Nucrel AN 4221C (all products of DuPont-Mitsui Polychemicals Co., Ltd.), and Escor ATX325, Escor ATX320 and Escor ATX310 (all products of ExxonMobil Chemical). Examples of commercial products that may be used as the metal ion neutralization product of the random copolymer in above component (a-2) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). These may be used singly or in combinations of two or more thereof as the respective components.

Examples of sodium-neutralized ionomeric resins, which are preferred as the metal ion neutralization products of the above random copolymers, include Himilan 1605, Himilan 1601 and Surlyn 8120.

Either of above component (a-1) and above component (a-2) may be used singly, or both may be used together, as the base resin of the resin composition for the above intermediate layer. The two components are blended in a weight ratio of component (a-1) to component (a-2) of from 100:0 to 0:100 which is not subject to any particular limitation, although a weight ratio of from 50:50 to 0:100 is preferred.

The above-mentioned non-ionomeric thermoplastic elastomer (B) is a component which is preferably included so as to further improve the feel of the golf ball on impact and the ball rebound. In the present invention, the base resin (component A) and the non-ionomeric thermoplastic elastomer (component B) are sometimes referred to collectively as "the resin component." Examples of this component B include olefin elastomers, styrene elastomers, polyester elastomers, urethane elastomers and polyamide elastomers. In the present invention, to further increase the rebound, it is especially preferable to use an olefin elastomer or a polyester elastomer. A commercially available product may be used as component B. Illustrative examples include the olefin elastomer Dynaron (JSR Corporation) and the polyester elastomer Hytrel (DuPont-Toray Co., Ltd.). These may be used singly or as combinations of two or more thereof.

The amount of component B included, expressed as the weight ratio A:B with above component A, may be set to from 100:0 to 50:50, and preferably from 100:0 to 60:40. If component B accounts for more than 50 wt % of the above resin component, the compatibility of respective components may decrease, which may markedly lower the durability of the golf ball.

Component C is a fatty acid and/or fatty acid derivative having a molecular weight of at least 228. This is a component which helps to improve the flow properties of the resin composition. Compared with the thermoplastic resin in the above resin component, component C has a very low molecular weight and, by suitably adjusting the melt viscosity of the mixture, helps in particular to improve the flow properties. Because the fatty acid (or fatty acid derivative) of the invention includes a high content of acid groups (or derivatives thereof) having a molecular weight of at least 228, there is little loss of resilience due to addition.

The fatty acid or fatty acid derivative of component C has a molecular weight of at least 228, preferably at least 256, more preferably at least 280, and even more preferably at least 300. The upper limit of the molecular weight is set to not more than 1500, preferably not more than 1000, even more preferably not more than 600, and most preferably not more than 500. If the molecular weight is too low, the heat resistance cannot be improved and the acid group content becomes too high, which may result in a smaller flow-improving effect due to interactions with acid groups present in component A. On the other hand, if the molecular weight is too high, a distinct flow-improving effect may not be achieved.

It is preferable to use as the fatty acid of component C an unsaturated fatty acid containing a double bond or triple bond on the alkyl moiety, or a saturated fatty acid in which the bonds on the alkyl moiety are all single bonds. The number of carbons on one molecule of the fatty acid may be set to at least 18, preferably at least 20, more preferably at least 22, and even more preferably at least 24. The upper limit in the number of carbons may be set to not more than 80, preferably not more than 60, more preferably not more than 40, and even more preferably not more than 30. Too few carbons, in addition to possibly resulting in a poor heat resistance, may also, by making the acid group content relatively high, lead to excessive interactions with acid groups present in the resin component, thereby diminishing the flow-improving effect. On the other hand, too many carbons increases the molecular weight, as a result of which a distinct flow-improving effect may not be achieved.

Illustrative examples of the fatty acid of component C include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

The fatty acid derivative is exemplified by metallic soaps in which the proton on the acid group of the fatty acid has been replaced with a metal ion. Examples of metal ions that may be used in the metal soap include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of the fatty acid derivative of component C include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. These may be used singly or as combinations of two or more thereof.

The amount of component C included per 100 parts by weight of the above resin component which includes components A and B may be set to at least 5 parts by weight, preferably at least 10 parts by weight, more preferably at least 15 parts by weight, and even more preferably at least 18 parts by weight. The upper limit is set to not more than 120 parts by weight, preferably not more than 80 parts by weight, more preferably not more than 60 parts by weight, and even more preferably not more than 50 parts by weight. If the amount of component C included is too small, the melt viscosity may decrease, lowering the processability. On the other hand, if the amount of component C is too high, the durability may decrease.

In the present invention, use may also be made of, as a mixture of the above-described components A and C, a known metallic soap-modified ionomer (see, for example, U.S. Pat. Nos. 5,312,857, 5,306,760, and International Disclosure WO 98/46671).

The basic inorganic metal compound of component D is included for the purpose of neutralizing acid groups in above components A and C. If component D is not included, particularly in cases where a metal-modified ionomeric resin alone (e.g., a metallic soap-modified ionomeric resin mentioned in the above-cited patent publications, alone) is mixed under applied heat, the metallic soap and un-neutralized acid groups present on the ionomer undergo an exchange reaction as shown below, generating a fatty acid. Because this generated fatty acid has a low thermal stability and readily vaporizes during molding, not only does it cause molding defects, when the generated fatty acid deposits on the surface of the molding, it causes a marked decline in paint film adhesion.

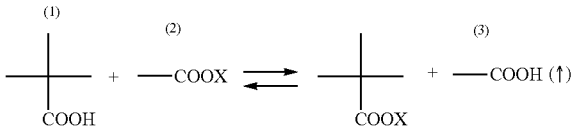

(1) un-neutralized acid group present on ionomeric resin (2) metallic soap (3) fatty acid X: metal cation To solve this problem, a basic inorganic metal compound (component D) which neutralizes acid groups present in above components A and C is included as an essential component. By including component D, acid groups present in above components A and C are neutralized and, through synergistic effects from the formulation of these respective components, the thermal stability of the resin composition increases, along with which a good moldability is imparted, thereby conferring the excellent property of enhancing resilience as a golf ball material.

It is recommended that component D be a basic inorganic metal compound which neutralizes acid groups in above components A and C, and preferably a monoxide. Because it has a high reactivity with the ionomeric resin and contains no organic matter in the reaction by-products, the degree of neutralization of the resin composition can be increased without a loss of thermal stability.

Illustrative examples of the metal ion used here in the basic inorganic metal compound include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Basic inorganic fillers containing these metal ions may be used as the inorganic metal compound. Illustrative examples include magnesium oxide, magnesium hydroxide, magnesium carbonate, zinc oxide, sodium hydroxide, sodium carbonate, calcium oxide, calcium hydroxide, lithium hydroxide and lithium carbonate. These may be used singly or as combinations of two or more thereof. In the present invention, of the above, a hydroxide or a monoxide is especially recommended. Calcium hydroxide and magnesium oxide, which have a high reactivity with component A, are preferred.

The amount of component D included per 100 parts by weight of the above resin component may be set to at least 0.1 part by weight, preferably at least 0.5 part by weight, more preferably at least 1 part by weight, and even more preferably at least 2 parts by weight. The upper limit is not more than 17 parts by weight, preferably not more than 15 parts by weight, more preferably not more than 13 parts by weight, and even more preferably not more than 10 parts by weight. If the amount of component D included is too small, improvements in the thermal stability and resilience may not be observed. On the other hand, if it is too large, the presence of excess basic inorganic metal compound may have the opposite effect of lowering the heat resistance of the composition.

The mixture obtained by mixing above components A to D has a degree of neutralization, based on the total amount of acid groups in the mixture, which is set to at least 50 mol %, preferably at least 60 mol %, more preferably at least 70 mol %, and even more preferably at least 80 mol %. With such a high degree of neutralization, even in cases where, for example, a metallic soap-modified ionomeric resin is used, exchange reactions between the metallic soap and un-neutralized acid groups present in the ionomeric resin are less likely to arise during mixture under heating, thereby reducing the likelihood of declines in thermal stability, moldability and resilience.

Various additives may be optionally included within the resin composition containing above components A to D. For example, additives such as pigments, dispersants, antioxidants, ultraviolet absorbers and light stabilizers may be suitably included. These additives are used in an amount which, although not subject to any particular limitation, is generally at least 0.1 part by weight, preferably at least 0.5 part by weight, and more preferably at least 1 part by weight per 100 parts by weight of the above resin component. The upper limit is not more than 10 parts by weight, preferably not more than 6 parts by weight, and more preferably not more than 4 parts by weight.

The resin composition may be obtained by mixing the above-described components A to D under applied heat. For example, the resin composition may be obtained by mixture using a known mixing apparatus such as a kneading-type twin-screw extruder, a Banbury mixer or a kneader at a heating temperature of from 150 to 250° C. Alternatively, direct use may be made of a commercial product, illustrative examples of which include those available under the trade names HPF 1000, HPF 2000 and HPF AD1027, as well as the experimental material HPF SEP1264-3, all produced by E.I. DuPont de Nemours & Co.

The method of forming the intermediate layer may be a known method and is not subject to any particular limitation. For example, use may be made of a method which involves placing a prefabricated core in a mold, and injection-molding the resin composition prepared as described above.

The construction of the above-described intermediate layer is not limited to a single layer; if necessary, two or more like or unlike intermediate layers may be formed within the above range. By forming a plurality of intermediate layers, the spin rate at the time of impact with a driver can be further reduced, enabling a further increase in the distance to be achieved. In addition, the spin properties and feel at the time of impact can be further improved.

Next, the resin composition used to form the cover of the inventive golf ball is described. In the present invention, a resin composition composed primarily of a polyurethane may be used as the resin composition from which the cover is formed. Preferred use may be made of a resin composition composed primarily of a thermoplastic polyurethane. Formation from a single resin blend composed primarily of (E) a thermoplastic polyurethane and (F) a polyisocyanate compound is especially preferred. Golf balls that use a cover formed of such a thermoplastic polyurethane have a high rebound and an excellent spin performance and scuff resistance, in addition to which the cover-forming material has a high flowability and thus an excellent manufacturability.

As used herein, the phrase "single resin blend" signifies that the resin blend is in the form of single resin pellets, and that it is preferable to form the cover by furnishing such single resin pellets to an injection molding machine.

This cover is composed primarily of the above (E) thermoplastic polyurethane and (F) polyisocyanate compound. Specifically, it is recommended that the combined weight of above component E and component F be at least 60%, and preferably at least 70%, of the overall weight of the cover.

The thermoplastic polyurethane serving as component E has a structure which includes soft segments made of a polymeric polyol that is a long-chain polyol (polymeric glycol), and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of a cyclic ether. The polyether polyol may be used singly or as a combination of two or more polyether polyols. Of these, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made of a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS K-1557.

Suitable chain extenders include those used in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation; preferred use may be made of one used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as component E to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of activated hydrogen atoms to isocyanate groups in the above polyurethane-forming reaction can be controlled within a desirable range so as to make it possible to obtain a golf ball which is composed in part of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component E. Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Illustrative examples of the thermoplastic polyurethane serving as component E include commercial products such as Pandex T8295, Pandex T8290, Pandex T8260, and Pandex T8295 (all available from DIC Bayer Polymer, Ltd.).

Next, concerning the polyisocyanate compound used as component F, it is essential that, in at least a portion thereof prior to injection molding, all the isocyanate groups on the molecule remain in an unreacted state. That is, polyisocyanate compound in which all the isocyanate groups on the molecule remain in a completely free state must be present in the single resin blend prior to injection molding. Such a polyisocyanate compound may be present together with a polyisocyanate compound in which only some of the isocyanate groups on the molecule are in a free state.

Various types of isocyanates may be employed without particular limitation as this polyisocyanate compound. Illustrative examples include one or more selected from the group consisting of 4,4'-diphenylmethane diisocyanate, 2,4-toluene, diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethyihexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable in terms of the balance between the influence on processability of such effects as the rise in viscosity that accompanies the reaction with the thermoplastic polyurethane serving as component E and the physical properties of the resulting golf ball cover material.

In the cover of the inventive golf ball, although not an essential constituent, a thermoplastic elastomer other than the above-described thermoplastic polyurethane may additionally be included as component G together with components E and F. Including this component G in the above resin composition enables the flowability of the resin composition to be further improved and enables increases to be made in various properties required of golf ball cover materials, such as resilience and scuff resistance.

Component G, which is a thermoplastic elastomer other than the above thermoplastic polyurethane, is exemplified by one or more thermoplastic elastomer selected from among polyester elastomers, polyamide elastomers, ionomeric resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because the resilience and scuff resistance are enhanced, owing to reactions with isocyanate groups, while at the same time a good manufacturability is retained.

The relative proportions of above components E, F and G are not subject to any particular limitation. However, to fully achieve the objects of the invention, it is preferable for the weight ratio E:F:G of the respective components to be from 100:2:50 to 100:50:0, and more preferably from 100:2:50 to 100:30:8.

In the present invention, the cover-forming resin blend is prepared by mixing together component E, component F, and also component G. It is necessary to select the mixing conditions such that at least some polyisocyanate compound in which all the isocyanate groups on the molecule remain in an unreacted state is present in the polyisocyanate compound. For example, treatment such as mixture in an inert gas (e.g., nitrogen) or in a vacuum state must be furnished. The resin blend is then injection-molded around a core which has been placed in a mold. For easy, trouble-free handling, it is preferable for the resin blend be formed into pellets having a length of 1 to 10 mm and a diameter of 0.5 to 5 mm. Isocyanate groups in an unreacted state remain within these resin pellets; while the resin blend is being injection-molded about the core, or due to post-treatment such as annealing thereafter, the unreacted isocyanate groups react with component E or component G to form a crosslinked material.

In addition, if necessary, various additives may also be included in this cover-forming resin blend. For example, pigments, dispersants, antioxidants, light stabilizers, ultraviolet absorbers, and parting agents may be suitably included.

The melt mass flow rate (MFR) of this resin blend at 210° C. is not subject to any particular limitation. However, to increase the flow properties and manufacturability, the MFR is preferably at least 5 g/10 min, and more preferably at least 6 g/10 min. If the melt mass flow rate of the resin blend is low, the flow properties will decrease, which may cause eccentricity during injection molding and may also lower the degree of freedom in the thickness of the cover that can be molded. The measured value of the melt mass flow rate is obtained in accordance with JIS K-7210 (1999 edition).

The method of molding the cover may involve feeding the above-described resin blend to an injection-molding machine and injecting the molten resin blend around the core. Although the molding temperature in this case will vary depending on the type of thermoplastic polyurethane, the molding temperature is generally in a range of from 150 to 250° C.

When injection molding is carried out, it is desirable though not essential to carry out molding in a low-humidity environment such as by purging with an inert gas (e.g., nitrogen) or a low-humidity gas (e.g., low dew-point dry air), or by vacuum treating, some or all places on the resin paths from the resin feed area to the mold interior. Illustrative, non-limiting, examples of the medium used for transporting the resin include low-humidity gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are to some degree in an unreacted state can be included within the resin blend, thus making it possible to reduce variable factors such as an unwanted rise in viscosity and enabling the actual crosslinking efficiency to be enhanced.

Techniques that may be used to confirm the presence of polyisocyanate compound in an unreacted state within the resin blend prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin blend (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin blend has been molded as described above to form a cover, its properties as a golf ball cover can be further improved by carrying out annealing so as to induce the crosslinking reaction to proceed further. "Annealing," as used herein, refers to aging the cover in a fixed environment for a fixed length of time.

The structure of the above cover is not limited to a single layer; if necessary, a cover of two or more layers may be formed of like or unlike materials. In this case, it is recommended that the cover have at least one layer that is formed of the above resin blend composed primarily of above components E and F, and that the hardness and thickness are adjusted so that these values for the overall cover fall within the above-indicated ranges.

In the golf ball of the present invention, to further enhance the aerodynamic properties and improve the distance, as in ordinary golf balls, it is preferable for numerous dimples to be formed on the surface of the cover. By optimizing such parameters as the number of dimple types and the total number of dimples, through synergistic effects with the above-described ball construction, there can be obtained a golf ball having a more stable trajectory and an improved distance performance. Moreover, to improve the design and durability of the golf ball, various treatments such as surface treatment, stamping and painting may be carried on the cover.

Here, it is recommended that the number of dimple types, which refers to the number of dimple types of mutually differing diameter and/or depth, be preferably at least two types, and more preferably at least three types. It is recommended that the upper limit be not more than eight types, and in particular not more than six types.

Because the golf ball of the present invention, owing to the above-described ball construction, tends to have a decreased spin rate at the time of impact, and thus a lower trajectory, it is preferable to carry out dimple design in such a way as to enable a large lift to be obtained.

First, the total number of dimples is from 280 to 360, preferably from 300 to 350, and more preferably from 320 to 340. If the number of dimples is higher than the above range, the ball trajectory may decrease, as a result of which a sufficient distance may not be achieved. On the other hand, if the number of dimples is lower than the above range, the trajectory may become too high, as a result of which an increased distance may not be achieved.

Nor is any particular limitation imposed on the geometrical arrangement of the dimples; use may be made of a known arrangement, such as an octahedral or an icosahedral arrangement. At this time, from the standpoint of reducing variability in the flight of the ball, preferred use may be made of a dimple arrangement such that the surface of the ball has thereon not even a single great circle which intersects no dimples. The dimple shapes are not limited to circular shapes, and may be of one or more types which are suitably selected from among polygonal, teardrop, oval and other shapes. The dimple diameter (in polygonal shapes, the diagonal length) is preferably from 2.5 to 6.5 mm. The dimple depth, although not subject to any particular limitation, is preferably set to from 0.08 to 0.30 mm.

The value $V_0$ obtained by dividing the spatial volume of each dimple below the flat plane circumscribed by the edge of that dimple by the volume of a cylinder whose base is the flat plane and whose height is the maximum depth of the dimple from the base, while not subject to any particular limitation, may be set in the present invention to from 0.35 to 0.80.

The ratio SR of the sum of the individual dimple surface areas, each defined by the border of the flat plane circumscribed by the edge of a dimple, with respect to the spherical surface area of the ball were it to be free of dimples, is not subject to any particular limitation. However, to reduce the air resistance, the ratio SR is preferably from 60 to 90%. This SR value can be increased by raising the number of dimples formed, interspersing a plurality of dimple types of differing diameter, and using dimple shapes in which the distance between neighboring dimples (land width) becomes substantially 0.

The ratio VR of the sum of the volumes of the individual dimples formed below the flat plane circumscribed by the dimple edge with respect to the volume of the ball sphere were it to have no dimples thereon, although not subject to any particular limitation, may be set in the present invention to from 0.6 to 1.

In the present invention, by setting these $V_0$, SR and VR values in the above-indicated ranges, the air resistance is reduced and a trajectory is easily obtained that enables a good distance to be achieved, thus making it possible to enhance the flight performance.

The golf ball of the invention may be made to conform with the Rules of Golf for competitive play, and may be formed to a diameter of not less than 42.67 mm. The weight may be set to generally not less than 45.0 g, and preferably not less than 45.2 g. It is preferable for the upper limit to be set to not more than 45.93 g.

EXAMPLES

The following Examples and Comparative Examples are provided by way of illustration and not by way of limitation.

Examples 1 to 3, Comparative Examples 1 to 7

Formation of Core

Solid cores were fabricated by preparing the rubber compositions shown in Table 1 below, then molding and vulcanizing at 155° C. for 15 minutes.

TABLE 1

| | Example | | | Comparative Example | | | | | | |
|---|---|---|---|---|---|---|---|---|---|---|
| Formulation (pbw) | 1 | 2 | 3 | 1 | 2 | 3 | 4 | 5 | 6 | 7 |
| Polybutadiene A | 0 | 0 | 0 | 0 | 0 | 0 | 0 | 100 | 0 | 0 |
| Polybutadiene B | 80 | 80 | 80 | 80 | 80 | 80 | 80 | 0 | 80 | 80 |
| Polybutadiene C | 20 | 20 | 20 | 20 | 20 | 20 | 20 | 0 | 20 | 20 |
| Zinc acrylate | 29.5 | 27.0 | 27.0 | 29.5 | 27.0 | 29.5 | 29.5 | 27 | 29.5 | 29.5 |
| Peroxide (1) | 0 | 0 | 0 | 0 | 0 | 0 | 0 | 0.6 | 0 | 0 |
| Peroxide (2) | 1.2 | 1.2 | 1.2 | 1.2 | 1.2 | 1.2 | 1.2 | 0.6 | 1.2 | 1.2 |
| Antioxidant | 0.1 | 0.1 | 0.1 | 0.1 | 0.1 | 0.1 | 0.1 | 0.1 | 0.1 | 0.1 |
| Barium sulfate | 19.6 | 20.6 | 20.6 | 19.6 | 20.6 | 19.6 | 25.9 | 0 | 19.5 | 19.6 |
| Zinc oxide | 5 | 5 | 5 | 5 | 5 | 5 | 5 | 23.9 | 5 | 5 |
| Zinc salt of pentachloro-thiophenol | 0.4 | 0.4 | 0.4 | 0.4 | 0.4 | 0.4 | 0.4 | 0.4 | 0.4 | 0.4 |

Details on the materials in Table 1 are given below.

Polybutadiene A

Available under the trade name "BR 01" from JSR Corporation.

Polybutadiene B

Available under the trade name "BR 730" from JSR Corporation.

Polybutadiene C

Available under the trade name "BR 51" from JSR Corporation.

Peroxide (1)

Available under the trade name "Percumyl D" from NOF Corporation.

Peroxide (2)

A mixture of 1,1-di(t-butylperoxy)cyclohexane and silica; available under the trade name "Perhexa C-40" from NOF Corporation.

Antioxidant 2,2'-Methylenebis(4-methyl-6-t-butylphenol); available under the trade name "Nocrac NS-6" from Ouchi Shinko Chemical Industry Co., Ltd.

Barium sulfate

Available under the trade name "Precipitated Barium Sulfate #300" from Sakai Chemical Industry Co., Ltd.

Zinc Stearate

Available under the trade name "Zinc Stearate G" from NOF Corporation.

Formation of Intermediate Layer and Cover

Next, using the various resin ingredients formulated as shown in Table 2, an intermediate layer and a cover were successively injection-molded around the core obtained as described above, thereby producing three-piece solid golf balls having an intermediate layer and a cover over the core. In Formulations (5), (6), (7) and (9) in Table 2, the respective starting materials (units: parts by weight) shown in Table 2 were worked together under a nitrogen gas atmosphere by a twin-screw extruder to give a cover resin blend. This resin blend was obtained in the form of pellets having a length of 3 mm and a diameter of 1 to 2 mm.

Figure 3:
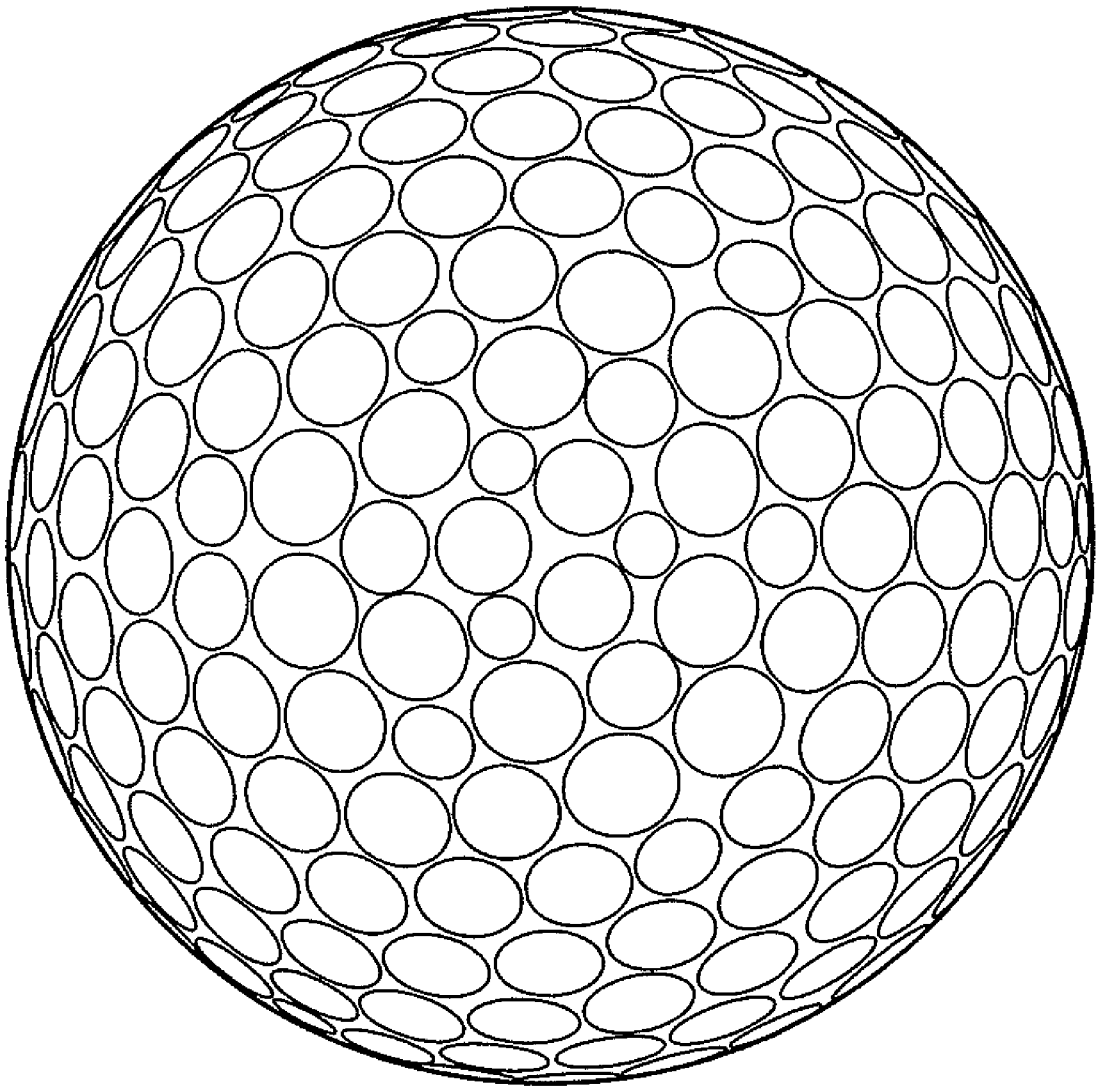
FIG. 3 is a top view of a golf ball showing the arrangement of dimples used in the examples of the invention and in the comparative examples.

The dimples shown in FIG. 3 were formed at this time on the cover surface. Details of the dimples in FIG. 3 are shown in Table 3.

TABLE 2

| Formulation (pbw) | (1) | (2) | (3) | (4) | (5) | (6) | (7) | (8) | (9) |
|---|---|---|---|---|---|---|---|---|---|
| Himilan AM7331 | | | | | | | | 50 | |
| Himilan 1557 | | | | | | | | 30 | |
| Himilan 1855 | | | | | | | | 20 | |
| Himilan 1605 | | 35 | | 100 | | | | | |
| Surlyn 9945 | | 35 | | | | | | | |
| AN4319 | 30 | | 100 | | | | | | |
| AN4221C | 60 | | | | | | | | |
| Dynaron 6100P | 10 | 30 | | | | | | | |
| Magnesium stearate | 60 | 0.31 | 100 | | | | | 1 | |
| Kyowamag MF150 | 1.3 | | 2.8 | | | | | | |
| Polytail | 4 | | 4 | | | | | | |
| TMP | | 1 | | 0.7 | | | | | |
| Titanium dioxide | | 0.5 | | | | | | 2.2 | |
| T8260 | | | | | | | 100 | | |
| T8295 | | | | | 75 | 25 | | | |
| T8290 | | | | | 25 | 75 | | | 75 |
| T8283 | | | | | | | | | 25 |
| Hytrel 4001 | | | | | 15 | 15 | 15 | | 15 |
| Titanium oxide | | | | | 3.5 | 3.5 | 3.5 | | 3.5 |
| Polyethylene wax | | | | | 1.5 | 1.5 | 1.5 | | 1.5 |
| Isocyanate compound | | | | | 9 | 9 | 9 | | 9 |

Details on the materials in Table 2 are given below.

Himilan

An ionomeric resin available from DuPont-Mitsui Polychemicals Co., Ltd.

Surlyn

An ionomeric resin available from E. I. DuPont de Nemours & Co.

AN4319, AN4221C

Available under the trade name "Nucrel" from DuPont-Mitsui Polychemicals Co., Ltd.

Dynaron 6100P

A hydrogenated polymer available from JSR Corporation.

Kyowamag MF150

Magnesium oxide available from Kyowa Chemical Industry Co., Ltd.

Polytail

A low-molecular-weight polyolefin polyol available from Mitsubishi Chemical Corporation.

TMP

Trimethylolpropane, available from Mitsubishi Gas Chemical Co., Ltd.

T8260, T8295, T8290, T8293

MDI-PTMG type thermoplastic Polyurethanes, available under the trade name "Pandex" from DIC Bayer Polymer.

Polyethylene Wax

Available under the trade name "Sanwax 161P" from Sanyo Chemical Industries, Ltd.

Isocyanate Compound 4,4'-Diphenylmethane diisocyanate.

Hytrel 4001

A polyester elastomer available from DuPont-Toray Co., Ltd.

TABLE 3

| No. | Number of dimples | Diameter (mm) | Depth (mm) | $V_0$ | SR | VR |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the border of the flat plane circumscribed by the edge of a dimple, as a percentage of surface area of ball sphere were it to have no dimples thereon.

VR: Sum of volumes of individual dimples formed below flat plane circumscribed by the edge of the dimple, as a percentage of volume of ball sphere were it to have no dimples thereon.

The golf balls obtained in Examples 1 to 3 of the invention and in Comparative Examples 1 to 7 were evaluated according to the criteria described below with regard to the following: properties such as thickness, hardness and deflection of each layer, flight performance and durability to repeated impact. The results are shown in Tables 4 and 5.

Evaluation of Ball Properties (1) Deflection (mm) of Core, Sphere Composed of Core Encased by Intermediate Layer, and Finished Ball The core, the sphere composed of the core encased by the intermediate layer, and the finished golf ball were placed on a hard plate, and the deflection of each when compressed under a final load of 1,275 N (130 kgf) from an initial load of 98 N (10 kgf) was measured.

(2) Surface Hardness of Core (JIS-C Hardness)

The surface of the core is spherical. The durometer indenter was set substantially perpendicular to this spherical surface, and JIS-C hardness measurements (in accordance with JIS-K6301) were taken at two randomly selected points on the surface of the core. The average of the two measurements was used as the core surface hardness.

(3) Cross-Sectional Hardness of Core (JIS-C Hardness)

The core was cut in half, thereby forming a flat plane. The durometer indenter was set substantially perpendicular to this flat plane, and the JIS-C hardness (in accordance with JIS-K6301) was measured.

(4) Material Hardness (JIS-C Hardness) of Intermediate Layer and Cover

The resin materials for the intermediate layer and the cover were formed into sheets having a thickness of about 2 mm, and the JIS-C hardness was measured in accordance with JIS-K6301.

(5) Material Hardness of Intermediate Layer and Cover (Shore D Hardness)

The resin materials for the intermediate layer and the cover were formed into sheets having a thickness of about 2 mm, and the hardness was measured with a Type D durometer in accordance with ASTM-2240.

(6) Initial Velocity of Core, Sphere Composed of Core Encased by Intermediate Layer, and Finished Ball The initial velocity was measured using an initial velocity measuring apparatus of the same type as the USGA drum rotation-type initial velocity instrument approved by the R&A. The ball was held isothermally at a temperature of 23±1° C. for at least 3 hours, then tested in a room temperature (23±2° C.) chamber. The ball was hit using a 250-pound (113.4 kg) head (striking mass) at an impact velocity of 143.8 ft/s (43.83 m/s). A dozen balls were each hit four times. The time taken for the balls to traverse a distance of 6.28 ft (1.91 m) was measured and used to compute the initial velocity. This cycle was carried out over a period of about 15 minutes.

(7) Flight

The distance traveled by the ball when shot at a head speed of 40 m/s with a driver (W#1) mounted on a golf swing robot was measured. The club used was a TourStage X-Drive 701 driver (loft angle,)10.5° manufactured by Bridgestone Sports Co., Ltd. The results were rated according to the criteria indicated below. The initial velocity and spin rate were values obtained by measuring the ball, immediately after impact, with an apparatus for measuring initial conditions.

Good: Total distance was 190 m or more

NG: Total distance was less than 190 m (8) Approach

The spin rate of a ball hit at a head speed of 20 m/s with a sand wedge (SW) mounted on a golf swing robot was measured. The club used was a TourStage TW-01 manufactured by Bridgestone Sports Co., Ltd. The results were rated according to the criteria indicated below.

Good: Spin rate of 5,700 rpm or more

NG: Spin rate of less than 5,700 rpm (9) W#1 Feel, Putter Feel

Sensory evaluations by ten amateur golfers having head speeds of 35 to 45 m/s with a driver (W#1) were carried out, and the feel was rated according to the following criteria.

Good: The ball had a good, soft feel

NG: The ball felt hard

(10) Durability to Repeated Impact

The ball was repeatedly hit at a head speed of 40 m/s with a W#1 club mounted on a golf swing robot. The balls in the respective examples were rated as shown below relative to an arbitrary durability index of 100 for the number of shots taken with the ball in Example 3 before the initial velocity fell below 97% of the average initial velocity for the first 10 shots. The average value for N=3 balls was used as the basis for evaluation in each example.

Good: Durability index was 90 or more

NG: Durability index was less than 90

(11) Scuff Resistance

A non-plated pitching sand wedge was set in a swing robot, and the ball was hit once at a head speed of 35 m/s, following which the surface state of the ball was visually examined and rated as follows.

Good: Can be used again

NG: Cannot be used again

TABLE 4

| | | Example | | |
|---|---|---|---|---|
| | | 1 | 2 | 3 |
| Core | Diameter (mm) | 37.35 | 37.30 | 37.30 |
| | Weight (g) | 32.2 | 32.1 | 32.1 |
| | Deflection, 10-130 kgf (mm) | 3.83 | 4.20 | 4.20 |

TABLE 4-continued

| | | Example | | |
|---|---|---|---|---|
| | | 1 | 2 | 3 |
| | Initial velocity (m/s) | 78.0 | 78.2 | 78.2 |
| | JIS-C surface hardness (S) | 80 | 78 | 78 |
| | JIS-C hardness 15 mm from center | 74 | 72 | 72 |
| | JIS-C hardness 7.5 mm from center | 67 | 65 | 65 |
| | JIS-C center hardness (C) | 60 | 58 | 58 |
| | Average (I) of JIS-C hardnesses at center and 15 mm from center | 67 | 64 | 64 |
| | (I) − JIS-C hardness 7.5 mm from center | 0 | −1 | −1 |
| | (S) − (C), JIS-C hardness | 20 | 20 | 20 |
| Intermediate layer | Material (type) | (1) | (1) | (1) |
| | Thickness (mm) | 1.64 | 1.66 | 1.66 |
| | Specific gravity | 0.94 | 0.94 | 0.94 |
| | Shore D hardness of sheet | 55 | 55 | 55 |
| | JIS-C hardness of sheet | 83 | 83 | 83 |
| Intermediate layer-encased sphere | Diameter (mm) | 40.62 | 40.61 | 40.61 |
| | Weight (g) | 39.6 | 39.5 | 39.5 |
| | Deflection, 10-130 kgf (mm) | 3.37 | 3.64 | 3.64 |
| | Initial velocity (m/s) | 78.2 | 78.4 | 78.4 |
| Initial velocity of intermediate layer-encased sphere − initial velocity of core (m/s) | | 0.3 | 0.2 | 0.2 |
| JIS-C hardness of intermediate layer material − JIS-C hardness of core surface | | 3 | 5 | 5 |
| (Deflection of intermediate layer-encased sphere)/(core deflection) | | 0.88 | 0.87 | 0.87 |
| Cover | Material (type) | (5) | (5) | (6) |
| | Thickness (mm) | 1.03 | 1.03 | 1.03 |
| | Shore D hardness of sheet | 53 | 53 | 50 |
| Ball | Diameter (mm) | 42.67 | 42.66 | 42.66 |
| | Weight (g) | 45.5 | 45.4 | 45.4 |
| | Deflection, 10-130 kgf (mm) | 3.09 | 3.29 | 3.36 |
| | Initial velocity (m/s) | 77.3 | 77.3 | 77.3 |
| Shore D hardness of cover material − Shore D hardness of intermediate layer material | | −2 | −2 | −5 |
| Initial velocity of ball − initial velocity of intermediate layer-encased sphere (m/s) | | −1.0 | −1.1 | −1.1 |
| (Ball deflection)/(Deflection of intermediate layer-encased sphere) | | 0.92 | 0.90 | 0.92 |
| Flight (W#1, HS 40 m/s) | Spin rate (rpm) | 2924 | 2836 | 2974 |
| | Total distance (m) | 191.5 | 192.5 | 190.7 |
| | Rating | good | good | good |
| Spin on approach shots | Spin rate (rpm) | 5867 | 5746 | 5921 |
| | Rating | good | good | good |
| Feel | W#1 | good | good | good |
| | Putter | good | good | good |
| Durability to repeated impact | Rating | good | good | good |
| Scuff resistance | Rating | good | good | good |

TABLE 5

| | | Comparative Example | | | | | | |
|---|---|---|---|---|---|---|---|---|
| | | 1 | 2 | 3 | 4 | 5 | 6 | 7 |
| Core | Diameter (mm) | 37.35 | 37.30 | 37.35 | 37.40 | 37.40 | 37.40 | 37.35 |
| | Weight (g) | 32.2 | 32.1 | 32.2 | 33.2 | 32.2 | 32.2 | 32.2 |
| | Deflection, 10-130 kgf (mm) | 3.83 | 4.20 | 3.83 | 3.80 | 3.70 | 3.83 | 3.83 |
| | Initial velocity (m/s) | 78.0 | 78.2 | 78.0 | 77.9 | 77.8 | 78.0 | 78.0 |
| | JIS-C surface hardness (S) | 80 | 78 | 80 | 80 | 75 | 80 | 80 |
| | JIS-C hardness 15 mm from center | 74 | 72 | 74 | 74 | 76 | 74 | 74 |
| | JIS-C hardness 7.5 mm from center | 67 | 65 | 67 | 67 | 70 | 67 | 67 |
| | JIS-C center hardness (C) | 60 | 58 | 60 | 60 | 64 | 60 | 60 |
| | Average (I) of JIS-C hardnesses at center and 15 mm from center | 67 | 64 | 67 | 67 | 70 | 67 | 67 |
| | (I) − JIS-C hardness 7.5 mm from center | 0 | −1 | 0 | 0 | 0 | 0 | 0 |
| | (S) − (C), JIS-C hardness | 20 | 20 | 20 | 20 | 11 | 20 | 20 |
| Intermediate layer | Material (type) | (2) | (1) | (3) | (1) | (1) | (4) | (3) |
| | Thickness (mm) | 1.63 | 1.66 | 1.63 | 1.60 | 1.60 | 1.60 | 1.63 |
| | Specific gravity | 0.94 | 0.94 | 0.96 | 0.94 | 0.94 | 0.95 | 0.96 |

TABLE 5-continued

| | | Comparative Example | | | | | | |
|---|---|---|---|---|---|---|---|---|
| | | 1 | 2 | 3 | 4 | 5 | 6 | 7 |
| | Shore D hardness of sheet | 55 | 55 | 48 | 55 | 55 | 62 | 48 |
| | JIS-C hardness of sheet | 83 | 83 | 74 | 83 | 83 | 92 | 74 |
| Intermediate layer-encased sphere | Diameter (mm) | 40.60 | 40.61 | 40.60 | 40.60 | 40.60 | 40.60 | 40.60 |
| | Weight (g) | 39.5 | 39.5 | 39.6 | 40.4 | 39.4 | 39.4 | 39.6 |
| | Deflection, 10-130 kgf (mm) | 3.40 | 3.64 | 3.42 | 3.37 | 3.30 | 3.00 | 3.42 |
| | Initial velocity (m/s) | 77.6 | 78.4 | 78.0 | 78.1 | 78.1 | 78.2 | 78.0 |
| Initial velocity of intermediate layer-encased sphere − initial velocity of core (m/s) | | −0.4 | 0.2 | 0.1 | 0.2 | 0.3 | 0.2 | 0.1 |
| JIS-C hardness of intermediate layer material − JIS-C hardness of core surface | | 3 | 5 | −6 | 3 | 8 | 12 | −6 |
| (Deflection of intermediate layer-encased sphere)/(core deflection) | | 0.89 | 0.87 | 0.89 | 0.89 | 0.89 | 0.78 | 0.89 |
| Cover | Material (type) | (5) | (7) | (5) | (8) | (5) | (5) | (9) |
| | Thickness (mm) | 1.05 | 1.05 | 1.03 | 1.05 | 1.05 | 1.05 | 1.03 |
| | Shore D hardness of sheet | 53 | 61 | 53 | 53 | 53 | 53 | 47 |
| Ball | Diameter (mm) | 42.70 | 42.70 | 42.67 | 42.70 | 42.70 | 42.70 | 42.67 |
| | Weight (g) | 45.5 | 45.5 | 45.6 | 45.5 | 45.5 | 45.5 | 45.6 |
| | Deflection, 10-130 kgf (mm) | 3.10 | 3.00 | 3.25 | 3.10 | 3.09 | 2.75 | 3.41 |
| | Initial velocity (m/s) | 76.8 | 77.2 | 77.1 | 77.3 | 77.2 | 77.3 | 77.1 |
| Shore D hardness of cover material − Shore D hardness of intermediate layer material | | −2 | 6 | 5 | −2 | −2 | −9 | −1 |
| Initial velocity of ball − initial velocity of intermediate layer-encased sphere (m/s) | | −0.8 | −1.2 | −0.9 | −0.8 | −0.9 | −0.9 | −0.9 |
| (Ball deflection)/(Deflection of intermediate layer-encased sphere) | | 0.91 | 0.82 | 0.95 | 0.92 | 0.94 | 0.92 | 1.00 |
| Flight (W#1, HS 40 m/s) | Spin rate (rpm) | 3025 | 2842 | 3005 | 3111 | 3015 | 2977 | 3275 |
| | Total distance (m) | 188.8 | 192.9 | 189.8 | 188.8 | 189.3 | 190.5 | 187.0 |
| | Rating | NG | good | NG | NG | NG | good | NG |
| Spin on approach shots | Spin rate (rpm) | 5877 | 5345 | 5870 | 5835 | 5879 | 5785 | 6015 |
| | Rating | good | NG | good | good | good | good | good |
| Feel | W#1 | good | good | good | good | good | good | good |
| | Putter | good | NG | good | good | good | good | good |
| Durability to repeated impact | Rating | good | good | good | good | good | NG | good |
| Scuff resistance | Rating | good | NG | good | NG | good | good | good |

From the results in Tables 4 and 5, the golf balls in Examples 1 to 3 according to the invention were better from the standpoint of all of the following: flight performance, spin on approach shots, feel, durability to repeated impact, and scuff resistance. The following results were obtained for the golf balls in the comparative examples.

The golf ball in Comparative Example 1 had a poor distance because the initial velocity of the sphere composed of the core encased by the intermediate layer was lower than the initial velocity of the core.

In the golf ball in Comparative Example 2, the cover was harder than the intermediate layer. As a result, the ball had a poor receptivity to spin on approach shots, and had a hard feel on shots with a putter. In addition, the ball had a poor durability to repeated impact.

In the golf ball in Comparative Example 3, the JIS-C hardness at the core surface was higher than the JIS-C hardness of the intermediate layer. As a result, the spin rate increased on shots with a W#1, preventing a sufficient distance from being achieved.

In the golf ball in Comparative Example 4, the cover was made of an ionomer. This ball had a poor scuff resistance, in addition to which the spin rate-lowering effect on shots with a W#1 was poor, as a result of which a sufficient distance was not achieved.

In the golf ball in Comparative Example 5, the JIS-C hardness difference (core surface hardness)−(core center hardness) was less than 15, as a result of which the spin rate was high, preventing a sufficient distance from being achieved.

In the golf ball in Comparative Example 6, the ratio (deflection of sphere composed of core encased by intermediate layer)/(core deflection) was less than 0.80, resulting in a poor durability to repeated impact.

In the golf ball in Comparative Example 7, the JIS-C hardness at the core surface was greater than the JIS-C hardness of the intermediate layer, as a result of which the spin rate on shots with a W#1 increased, preventing a sufficient distance from being achieved.

the invention claimed is:

1. A multi-piece solid golf ball comprising a solid core, at least one intermediate layer and a cover, wherein the core has a hardness which gradually increases from a core center to a core surface, the hardness difference in JIS-C hardness units between the core center and the core surface being at least 15 and, letting (I) be the calculated average value of the cross-sectional hardness measured at a position 15 mm from the core center and the cross-sectional hardness measured at the core center and letting (II) be the measured cross-sectional hardness at a position 7.5 mm from the core center, the hardness difference (I)-(II) in JIS-C hardness units being not more than +2; the intermediate layer has a material hardness and the core has a surface hardness which together satisfy the condition (JIS-C hardness of intermediate layer material)−(JIS-C hardness of core surface) >0;

a sphere composed of the core encased by the intermediate layer has an initial velocity and the core has an initial velocity which together satisfy the condition (initial velocity of sphere composed of core encased by intermediate layer)−(initial velocity of core) ≧0;

the sphere composed of the core encased by the intermediate layer has a deflection and the core has a deflection which together satisfy the condition 0.80 ≦(deflection of sphere composed of core encased by intermediate layer)/(deflection of core);

the cover is formed of a cover material composed primarily of polyurethane; and the cover material has a Shore D hardness and the intermediate layer material has a Shore D hardness which together satisfy the condition (Shore D hardness of cover material)−(Shore D hardness of intermediate layer material)≦0;

wherein thickness of the cover (mm) and thickness of the intermediate layer (mm) satisfy the following relationship:

cover thickness×1.2<intermediate layer thickness<cover thickness×2.5; and wherein the ball has a deflection and the sphere composed of the core encased by the intermediate layer has a deflection which together satisfy the condition 0.85<(ball deflection)/(deflection of sphere composed of core encased by intermediate layer)≦0.97.

2. The multi-piece solid golf ball of claim 1, wherein the intermediate layer is formed primarily of a resin mixture obtained by blending as essential components:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio of from 100:0 to 0:100, and (B) a non-ionomeric thermoplastic elastomer in a weight ratio of from 100:0 to 50:50;

(C) from 5 to 120 parts by weight of a fatty acid and/or fatty acid derivative having a molecular weight of from 228 to 1500; and (D) from 0.1 to 17 parts by weight of a basic inorganic metal compound capable of neutralizing un-neutralized acid groups in component A and component C.

3. The multi-piece solid golf ball of claim 1, wherein the hardness difference (I)-(II) in JIS-C units is not more than ±1.

4. The multi-piece solid golf ball of claim 1, wherein the initial speed of the sphere composed of the core encased by the intermediate layer and the initial speed of the core together satisfy the condition (initial speed of sphere composed of core encased by intermediate layer)−(initial speed of core)≧0.2.

5. The multi-piece solid golf ball of claim 1, wherein the deflection of the sphere composed of the core encased by the intermediate layer and the deflection of the core together satisfy the condition 0.80<(deflection of sphere composed of core encased by intermediate layer)/(deflection of core)≦0.92.

6. The multi-piece solid golf ball of claim 1, wherein the intermediate layer material has a Shore D hardness of from 50 to 60.

* * * * *